US010724759B2

(12) United States Patent
Shirota et al.

(10) Patent No.: US 10,724,759 B2
(45) Date of Patent: Jul. 28, 2020

(54) INDOOR UNIT FOR AIR-CONDITIONING APPARATUS

(71) Applicant: Mitsubishi Electric Corporation, Tokyo (JP)

(72) Inventors: Mitsuhiro Shirota, Tokyo (JP); Yuya Yamashita, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 29 days.

(21) Appl. No.: 15/779,909

(22) PCT Filed: Feb. 2, 2016

(86) PCT No.: PCT/JP2016/053063
§ 371 (c)(1),
(2) Date: May 30, 2018

(87) PCT Pub. No.: WO2017/134744
PCT Pub. Date: Aug. 10, 2017

(65) Prior Publication Data
US 2018/0363943 A1 Dec. 20, 2018

(51) Int. Cl.
*F24F 13/15* (2006.01)
*F24F 1/0011* (2019.01)
(Continued)

(52) U.S. Cl.
CPC ..... *F24F 13/15* (2013.01); *F24F 1/0011* (2013.01); *F24F 1/0057* (2019.02); *F24F 13/20* (2013.01); *F24F 2221/28* (2013.01)

(58) Field of Classification Search
CPC ..... F24F 13/15; F24F 1/0057; F24F 1/0011; F24F 13/20; F24F 2221/28
See application file for complete search history.

(56) References Cited

U.S. PATENT DOCUMENTS 5,873,780 A * 2/1999 Mori ..... F24F 1/0057 454/285
10,436,473 B2 * 10/2019 Kuramori ..... F24F 13/22
(Continued)

FOREIGN PATENT DOCUMENTS

EP 2 241 832 A1 10/2010
JP 2010-249360 A 11/2010
KR 101425774 B1 * 8/2014 ..... F15C 4/00

OTHER PUBLICATIONS

International Search Report of the International Searching Authority dated May 10, 2016 for the corresponding international application No. PCT/JP2016/053063 (and English translation).

*Primary Examiner* — Kun Kai Ma
(74) *Attorney, Agent, or Firm* — Posz Law Group, PLC

(57) ABSTRACT

An indoor unit for an air-conditioning apparatus includes: a casing, which is to be attached to a wall in a room at a back surface side of the casing; an air inlet and an air outlet, which are formed in the casing; an indoor heat exchanger and an indoor fan, which are arranged in an air passage continuous from the air inlet to the air outlet; an up-and-down airflow direction plate, which is provided in the air outlet so as to be turnable, forms an air outlet passage for blowing air to be blown out through the air outlet in a region located below the air outlet, and is configured to change a direction of the blowing air; and an up-and-down airflow direction assist plate, forms the air outlet passage and is configured to change the direction of the blowing air between the up and down directions.

6 Claims, 6 Drawing Sheets

(51) Int. Cl.
*F24F 1/0057* (2019.01)
*F24F 13/20* (2006.01)

(56) References Cited

U.S. PATENT DOCUMENTS

| | | | | |
|---|---|---|---|---|
| 2003/0167786 | A1* | 9/2003 | Nakagawa | F24F 1/0007 62/285 |
| 2004/0007002 | A1* | 1/2004 | Asami | F24F 1/0011 62/186 |

* cited by examiner

INDOOR UNIT FOR AIR-CONDITIONING APPARATUS

CROSS REFERENCE TO RELATED APPLICATION

This application is a U.S. national stage application of International Application No. PCT/JP2016/053063, filed on Feb. 2, 2016, the contents of which are incorporated herein by reference.

TECHNICAL FIELD

The present invention relates to an indoor unit for an air-conditioning apparatus, and more particularly, to an up-and-down airflow direction plate in an air outlet.

BACKGROUND

A related-art indoor unit for an air-conditioning apparatus includes a fan provided in an air passage continuous from an air inlet to an air outlet, and a heat exchanger provided in a periphery of the fan. The indoor unit further includes an airflow direction plate. The airflow direction plate is designed to prevent dew condensation during a cooling operation while freely controlling a direction of an airflow blown out through the air outlet from a direction in which a front of the indoor unit faces to a direction in which a bottom of the indoor unit faces.

For example, an indoor unit for an air-conditioning apparatus disclosed in Patent Literature 1 includes an air outlet in a lower portion of a casing. In the air outlet, there are provided two up-and-down airflow direction plates, which can be driven independently of each other. When phases of the two up-and-down airflow direction plates are in a predetermined relationship, one of the up-and-down airflow direction plates restricts rotation of the other so that the up-and-down airflow direction plates become non-rotatable. With this configuration, inadvertent rotation is prevented. Thus, even when the up-and-down airflow direction plate is moved manually, the up-and-down airflow direction plates do not become non-rotatable.

PATENT LITERATURE

Patent Literature 1: Japanese Unexamined Patent Application Publication No. 2010-249360

However, in the indoor unit for an air-conditioning apparatus disclosed in Patent Literature 1, one of the up-and-down airflow direction plate restricts the movement of the other up-and-down airflow direction plate with a complicated configuration using a plurality of components other than the two up-and-down airflow direction plates. Therefore, the indoor unit for an air-conditioning apparatus has a problem in that the number of components is increased, and further, the number of assembly steps is increased at the time of manufacture.

SUMMARY

The present invention has been made to solve the above problem, and an object of the invention is to provide an indoor unit for an air-conditioning apparatus, which is easily assembled without increasing the number of components, and is provided with two up-and-down airflow direction plates that do not become non-rotatable.

According to one embodiment of the present invention, there is provided an indoor unit for an air-conditioning apparatus, including: a casing, which is to be attached to a wall in a room on a back surface side of the casing; an air inlet and an air outlet, which are formed in the casing; a heat exchanger and a fan, which are arranged in an air passage continuous from the air inlet to the air outlet; an up-and-down airflow direction plate, which is provided in the air outlet so as to be turnable, forms an air outlet passage for blowing air to be blown out through the air outlet in a region located below the air outlet, and which is configured to change a direction of the blowing air between upward and downward directions; and an up-and-down airflow direction assist plate, which is turned closer to a front surface side of the casing than the up-and-down airflow direction plate, forms the air outlet passage at a position located below the air outlet, and is configured to change the direction of the blowing air between the upward and downward directions, in which a rotation locus of a distal end of the up-and-down airflow direction plate crosses a locus of the up-and-down airflow direction assist plate, in which the distal end of the up-and-down airflow direction plate includes a ridge line portion having a curved surface having a radial dimension R, in which the up-and-down airflow direction assist plate includes a protruding portion protruding by a protruding dimension P on a surface with which the distal end of the up-and-down airflow direction plate allowed to be in contact, and in which the protruding dimension P of the protruding portion is smaller than the radial dimension R.

According to one embodiment of the present invention, during a cooling operation of the air-conditioning apparatus, the up-and-down airflow direction plate and the up-and-down airflow direction assist plate is turned independently of each other, and can change the direction of the blowing air. Further, the rotation locus of the distal end of the up-and-down airflow direction plate and the rotation locus of the end portion on the back surface side of the up-and-down airflow direction assist plate cross each other, and the distal end of the up-and-down airflow direction plate and the surface on the back surface side of the up-and-down airflow direction assist plate can be held in contact with each other. However, the up-and-down airflow direction assist plate only has a protrusion smaller than a roundness having the radial dimension R, which is formed on the ridge line portion on the distal end of the up-and-down airflow direction plate. Thus, the distal end of the upper airflow direction plate is not caught on the up-and-down airflow direction assist plate, and is not stopped. With this configuration, the indoor unit for the air-conditioning apparatus can be obtained, in which the number of components is small, and which can be easily assembled at the time of manufacture.

DETAILED DESCRIPTION

Figure 1:
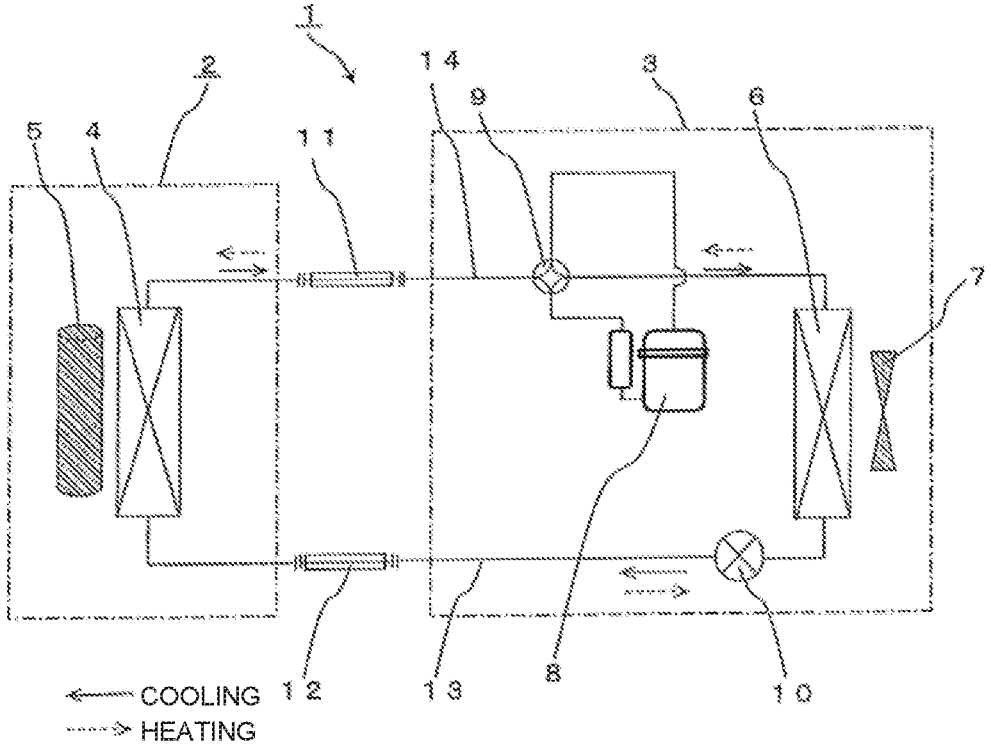
FIG. 1 is a schematic view for illustrating a refrigerant circuit for an air-conditioning apparatus according to Embodiment 1 of the present invention.

An embodiment of the present invention will be described with reference to the drawings. In each of the drawings, devices denoted by the same reference symbols are the same as or correspond to those as illustrated in the other drawings, and the same applies hereinafter. Further, the modes of components described herein are merely illustrative, and the present invention is not limited to those described herein. In particular, combinations of the components are not limited to the combinations in embodiments, and components described in one embodiment may be applied to another embodiment. Further, with regard to a plurality of devices of the same type which are distinguished by suffixes, in the case where the devices are not particularly required to be distinguished or specified, the suffixes are omitted in some cases. In addition, there is a case where the relationship between the sizes of the components as illustrated in the drawings differs from that between the actual sizes of the components.

Embodiment 1

Configuration of Refrigerant Circuit 13 of Air-Conditioning Apparatus 1

FIG. 1 is a schematic view for illustrating a refrigerant circuit for an air-conditioning apparatus 1 according to Embodiment 1 of the present invention. As illustrated in FIG. 1, in the air-conditioning apparatus 1, there are provided an indoor unit 2 and an outdoor unit 3, which are connected to each other by a gas-side communication pipe 11 and a liquid-side communication pipe 12, thereby forming a refrigerant circuit 13. The indoor unit 2 includes an indoor heat exchanger 4 therein, and a refrigerant pipe leading to the outside of the indoor unit 2 is connected to the indoor heat exchanger 4. The outdoor unit 3 includes therein a four-way switching valve 9, a compressor 8, an outdoor heat exchanger 6, and an expansion valve 10, which are connected to one another by refrigerant pipes. As described above, in the refrigerant circuit 13, the indoor heat exchanger 4, the four-way switching valve 9, the compressor 8, the outdoor heat exchanger 6, and the expansion valve 10 are connected to one another by the refrigerant pipes, thereby providing a refrigeration cycle. Further, an indoor fan 5 is provided in the vicinity of the indoor heat exchanger 4, and an outdoor fan 7 is installed in the vicinity of the outdoor heat exchanger 6.

Configuration of Outdoor Unit 3

In the outdoor unit 3, the expansion valve 10, the outdoor heat exchanger 6, and the four-way switching valve 9 are connected to one another in series by the refrigerant pipes. The four-way switching valve 9 is connected to the outdoor heat exchanger 6, a suction port and a discharge port of the compressor 8, and the refrigerant pipe connected to the gas-side communication pipe 11. The four-way switching valve 9 can switch the operation to be performed between a heating operation and a cooling operation by effecting switching between connection destinations of the discharge port and the suction port. In the passage of the four-way switching valve 9 indicated by the solid lines in FIG. 1, the refrigerant pipe connected to the gas-side communication pipe 11 and the suction port of the compressor 8 are connected to each other, and the discharge port of the compressor 8 and the outdoor heat exchanger 6 are connected to each other. In this case, the air-conditioning apparatus 1 performs the cooling operation. On the other hand, in the passage of the four-way switching valve 9 indicated by the broken lines in FIG. 1, the outdoor heat exchanger 6 and the suction port of the compressor 8 are connected to each other, and the discharge port of the compressor and the refrigerant pipe connected to the gas-side communication pipe 11 are connected to each other. In this case, the air-conditioning apparatus 1 performs the heating operation.

Configuration of Indoor Unit 2

Figure 2:
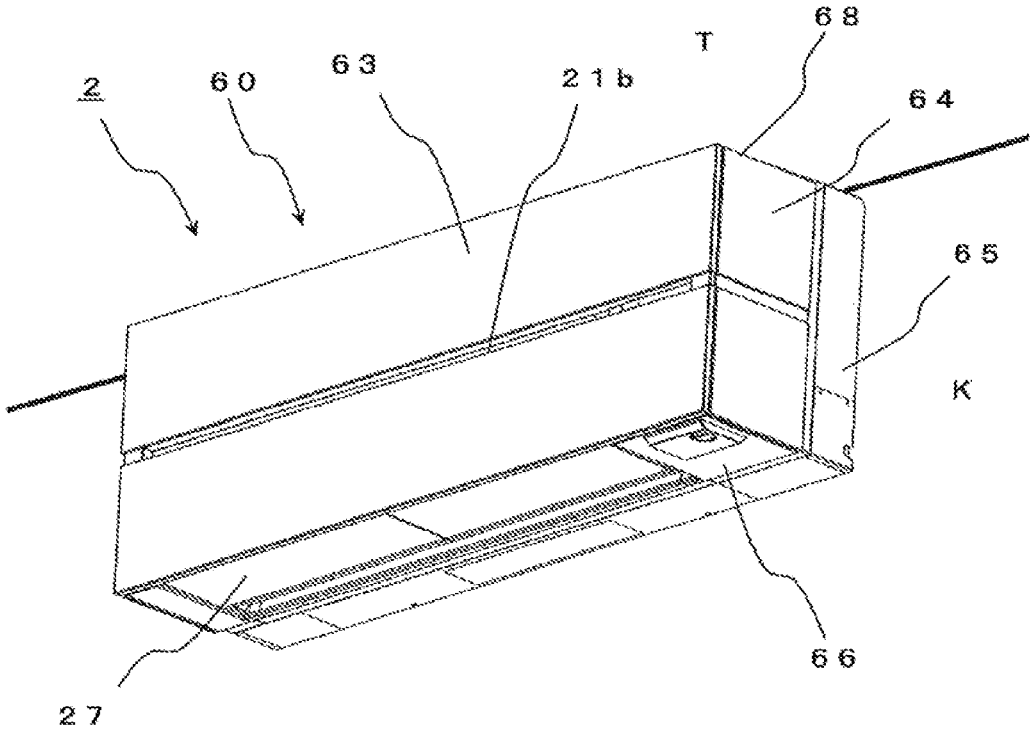
FIG. 2 is a perspective view of an indoor unit for the air-conditioning apparatus according to Embodiment 1 of the present invention.
Figure 3:
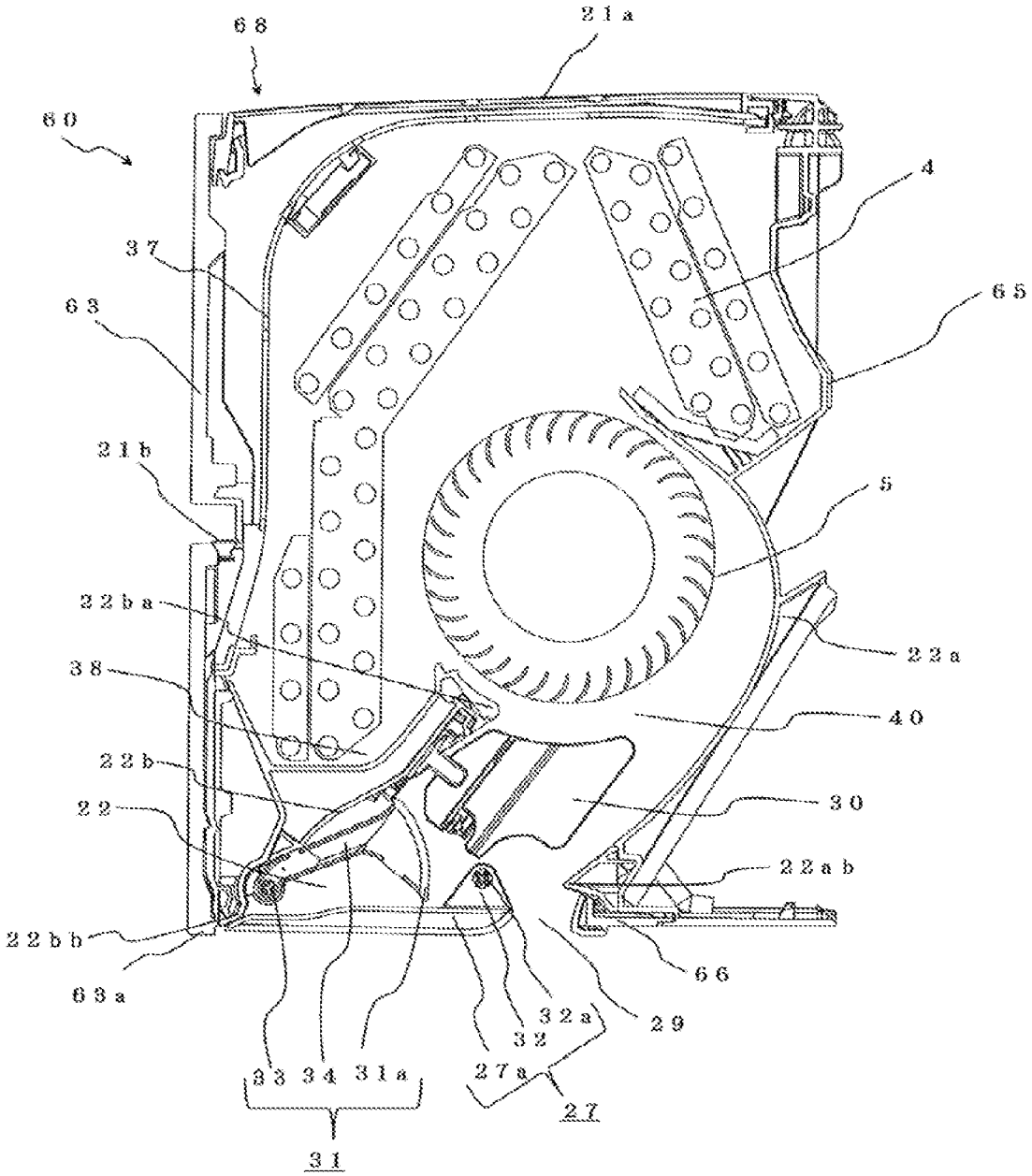
FIG. 3 is an explanatory view for illustrating a cross section perpendicular to the longitudinal direction of the indoor unit as illustrated in FIG. 2.
Figure 4:
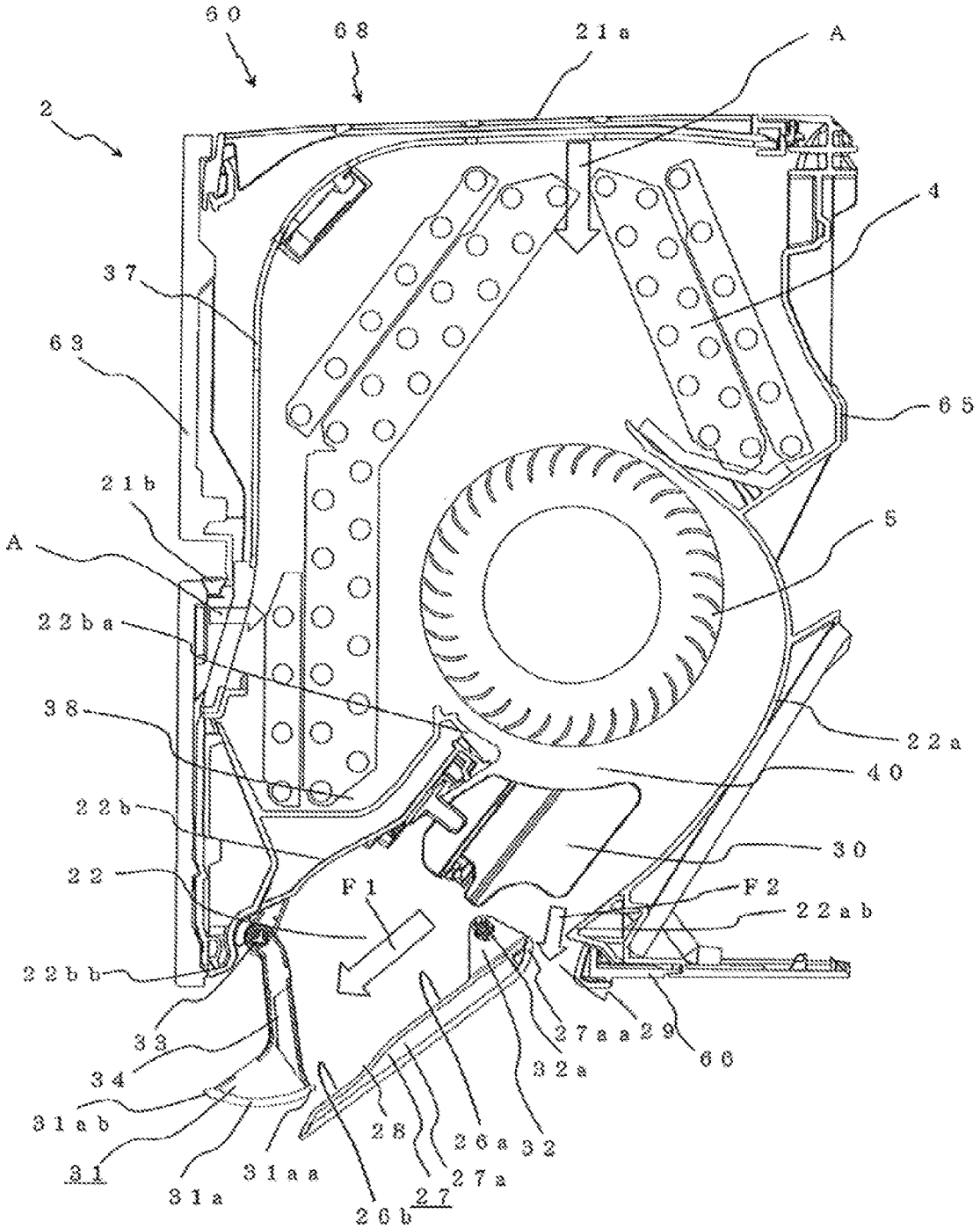
FIG. 4 is an explanatory view for illustrating a cross section perpendicular to the longitudinal direction of the indoor unit as illustrated in FIG. 2 when the indoor unit is in an operation stopped state.

FIG. 2 is a perspective view of the indoor unit 2 for the air-conditioning apparatus 1 according to Embodiment 1 of the present invention. FIG. 3 is an explanatory view for illustrating a cross section perpendicular to the longitudinal direction of the indoor unit 2 of FIG. 2. FIG. 4 is an explanatory view for illustrating a cross section perpendicular to the longitudinal direction of the indoor unit 2 in the operation state. FIG. 3 is an explanatory view of the indoor unit 2 in an operation stopped state. In FIG. 2, a ceiling surface T is a ceiling surface in a room on which the indoor unit 2 is installed. A wall surface K is a wall surface on which the indoor unit 2 is installed. A surface of the indoor unit 2, which is located on the wall surface K side, is defined as a back surface of the indoor unit 2. Of surfaces forming the outer appearance of the indoor unit 2, the opposite surface of the back surface is referred to as a front surface. A surface of the indoor unit 2, which is located on the ceiling surface T side, is referred to as a top surface. Of the surfaces forming the outer appearance of the indoor unit 2, the opposite surface of the top surface is defined as a lower surface. A side surface on the right side in FIG. 2 is defined as a right side surface. The opposite surface of the right side surface is defined as a left side surface. Further, internal components of the indoor unit 2 are similarly described.

As illustrated in FIG. 2, the indoor unit 2 includes a casing 60 having a horizontally long rectangular parallelepiped shape. In the casing 60, a front surface is covered with a front panel 63, right and left side surfaces are covered with side panels 64, and a back surface is covered with a back panel 65. The front panel 63 is provided in parallel to the wall surface K, and is formed as a single flat surface that is flat from the top surface to the lower surface except for a recessed portion serving as an air inlet 21. Further, a lower end 63*a* of the front panel 63 forms an end portion of the lower surface of the casing 60, which is located on the front surface side. The lower surface is covered with the back panel 65, a lower panel 66, and an up-and-down airflow direction plate 27. The top surface is covered with a top panel 68, and the top panel 68 has a matrix-like opening portion. This opening portion is an air inlet 21*a*. A slit is also formed in the vicinity of the center of the front panel 63 in the height direction of the casing 60, and the slit is an air inlet 21*b*. The lower panel 66 is parallel to a floor surface in a room. The shape of the casing 60 of the indoor unit 2 is not limited to the horizontally long rectangular parallelepiped shape, and is not limited only to the shape as illustrated in FIG. 2 as long as the casing 60 has a box-like shape in which the air inlet 21 for taking in air and an air outlet 22 for blowing out air are each formed at one or more positions. The position and the shape of the air inlet may be set in accordance with needed air volume and design, and the air inlet may be formed only in the top surface, or may be formed only in the front surface. Further, the air outlet 22 is not limited to one opened to face a region located just below the casing 60, and may be opened to face obliquely toward the front surface side of the casing 60.

In the case where the indoor unit 2 has the horizontally long rectangular parallelepiped shape, the air outlet 22 is provided only in the lower surface of the casing 60, and the air outlet is provided close to the front panel side as in the indoor unit 2 according to Embodiment 1 illustrated in FIG. 2, the air outlet 22 cannot be seen as the indoor unit 2 is seen from the front surface during operation stop, as a result of which the design can be improved. On the other hand, during the operation, in angle, air can be easily blown outdownward, and thus the air can be caused to reach the floor surface.

As illustrated in FIG. 3, in the inside of the casing 60, the indoor fan 5, which is configured to generate a flow of air, with a motor (not shown) driven, is accommodated. The indoor heat exchanger 4 is provided in a periphery of a top surface side and a front surface side of the indoor fan 5. An air passage 40 leading to the air outlet 22 is formed below the indoor fan 5. On a front surface wall 22*b* of the air outlet 22, right-and-left airflow direction plates 30 configured to adjust a right-and-left airflow direction are installed just in front of the air outlet 22 in the air passage 40. An up-and-down airflow direction plate 27 and an up-and-down airflow direction assist plate 31 configured to adjust an up-and-down airflow direction are provided in the air outlet 22. Further, a filter 37 is provided on an upstream side with respect to the indoor heat exchanger 4, and a drain pan 38 is provided below the indoor heat exchanger 4 so as to collect condensed water generated in the indoor heat exchanger 4.

Air Passage 40 and Air Outlet 22

The air passage 40 includes a back surface wall 22*a* on the back surface side, and a front surface wall 22*b* on the front surface side. The back surface wall 22*a* is formed so as to extend downward from a back surface side of the indoor fan 5 to a lower side of the indoor fan 5, thereby leading to the air outlet 22. That is, the back surface wall 22*a* forms an inclined surface from the back surface side of the indoor fan 5 in the direction toward the front surface, and is located so that a terminal end 22*ab* of the back surface wall 22*a* is in contact with an internal side of the lower panel 66.

The front surface wall 22*b* of the air outlet 22 has a starting point 22*ba* located directly below the indoor fan 5 and close to the front surface, and extends therefrom obliquely downward toward the front surface side to lead to the air outlet 22. A terminal end 22*bb* of the front surface wall 22*b*, that is, an end portion on the air outlet 22 side, is located right behind the lower end 63*a* of the front panel 63 of the indoor unit 2.

Figure 5:
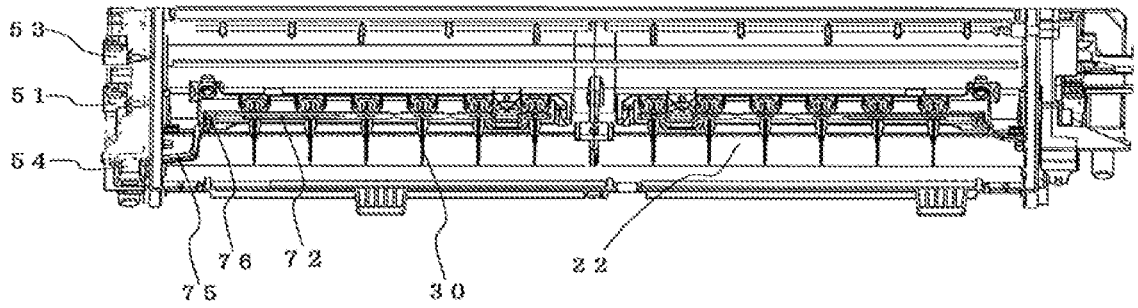
FIG. 5 is a view for illustrating an outer appearance of an air outlet constructing part of the indoor unit as illustrated in FIG. 1.

FIG. 5 is a view for illustrating an outer appearance of an air outlet forming part of the indoor unit 2 of FIG. 1. FIG. 5 is an outer appearance view for illustrating a state in which the up-and-down airflow direction plate 27 and the up-and-down airflow direction assist plate 31 are removed from the air outlet constructing part, and is a view as seen from the lower surface side of the indoor unit 2. The plurality of right-and-left airflow direction plates 30 are installed in the air outlet 22. The plurality of right-and-left airflow direction plates 30 are coupled to a right-and-left airflow direction plate driving motor 54 by a right-and-left airflow direction plate coupling rod 72, a coupling portion 76, and a right-and-left airflow direction plate driving motor coupling rod 75. When the right-and-left airflow direction plate driving motor 54 is rotated, it can change the direction of the right-and-left airflow direction plates 30 by moving the right-and-left airflow direction plate coupling rod 72 in the right-and-left direction. An up-and-down airflow direction plate driving motor 51 is configured to turn the up-and-down airflow direction plate 27. An up-and-down airflow direction assist plate driving motor 53 is configured to drive the up-and-down airflow direction assist plate 31. The up-and-down airflow direction plate 27 and the up-and-down airflow direction assist plate 31 can perform rotating operations independently of each other by the motors, respectively.

Up-and-Down Airflow Direction Plate 27

The up-and-down airflow direction plate 27 is attached to a rotation shaft 32*a*, and is supported so as to be turnable about the rotation shaft 32*a*. The rotation shaft 32*a* is located on the back surface side of the air outlet 22, and is provided in the vicinity of the back surface wall 22*a* of the air outlet 22 through a gap 29 from the terminal end 22*ab* of the back surface wall 22*a*. Further, the rotation shaft 32*a* is provided in the inside of the air outlet 22. During the operation, the up-and-down airflow direction plate 27 is opened in a direction in which the air outlet 22 faces downward, and the blowing air is blown out through both the air outlet 22 and the gap 29. The up-and-down airflow direction plate 27 and the front surface wall 22*b* in the inside of the air outlet 22 are arranged opposite to each other, and a space between the opposed plate and wall serves as an air outlet passage for a main flow F1 of the blowing air. The up-and-down airflow direction plate 27 includes a plate-like portion 27*a* extending along the longitudinal direction of the air outlet 22, and a support member 32 protruding from the plate-like portion. The support member 32 is attached to the rotation shaft 32*a*. The up-and-down airflow direction plate 27 is configured to change the airflow direction of the air to be blown out through the air outlet 22 between the up and down directions by moving the plate-like portion 27*a* in the up or down direction, using the up-and-down direction support member 32. As illustrated in FIG. 4, the up-and-down airflow direction plate 27 is rotated downward about a rotation shaft 33 during the operation to open the air outlet 22, and is adjusted in rotation angle to adjust the direction of the air to be blown out between the up and down directions. The blowing air to be blown out through the air outlet 22 is referred to as the main flow F1, and the blowing air blown out through the gap 29 is referred to as a sub-flow F2. When the up-and-down airflow direction plate 27 is opened, the up-and-down airflow direction plate 27 guides the main flow F1 of the blowing air in a region located below the air outlet 22.

A surface of the plate-like portion 27*a* of the up-and-down airflow direction plate 27, which is located on the main flow F1 side of the blowing air, has two surfaces for guiding the blowing air, which form the air outlet passage. Of the two surfaces for guiding the blowing air, the surface located on an upstream side of the main flow F1 of the blowing air is referred to as an upstream guide surface 26*a*, and the surface located on a downstream side of the upstream guide surface 26*a* is referred to as a downstream guide surface 26*b*. The downstream guide surface 26*b* is located on an inner side of the air outlet passage with respect to the upstream guide surface 26*a*. In the up-and-down airflow direction plate 27, a step 28 is formed between the upstream guide surface 26*a* and the downstream guide surface 26*b*. The step 28 is formed to have a smooth surface as, for example, an inclined surface, a curved surface, or a combination of the inclined surface and the curved surface. In Embodiment 1, the step 28 has an S-shape by connecting curved surfaces having a great curvature to guide the blowing air flowing along the upstream guide surface 26*a* to the downstream guide surface 26*b* while keeping the blowing air in contact with the front surface. The step 28 is provided on a downwind side with respect to the center of the plate-like portion 27*a*. Further, the up-and-down airflow direction plate 27 includes a tapered surface 25 at a distal end thereof. The tapered surface 25 is located on the main flow F1 side of the blowing air, and is smoothly connected to the downstream guide surface 26*b*. In Embodiment 1, the downstream guide surface 26*b* and the tapered surface 25 are connected to each other by a curved surface. In Embodiment 1, the upstream guide surface 26*a* and the downstream guide surface 26*b* are flat. However, the upstream guide surface 26*a* and the downstream guide surface 26*b* may be curved as long as they can guide the blowing air.

The indoor unit 2 as illustrated in FIG. 3 is in the operation stopped state, and the up-and-down airflow direction plate 27 covers the air outlet 22. In the operation stopped state of the indoor unit 2, the distal end portion of the plate-like portion 27*a* of the up-and-down airflow direction plate 27 reaches an end on the front surface side of the opening portion of the air outlet 22, that is, the terminal end 22*bb* of the front surface wall 22*b*. The plate-like portion 27*a* of the up-and-down airflow direction plate 27 closes the air outlet 22 so that the inside of the indoor unit 2 cannot be seen. Further, in the operation stopped state, the rotation shaft 32*a*, which corresponds to the center of turning of the up-and-down airflow direction plate 27, is provided on an upper side with respect to the plate-like portion 27*a*.

The up-and-down airflow direction plate 27 is turnable about the rotation shaft 32*a* in the range from an upper-structure contact state (fully-closed state) to a lower-structure contact state (fully-opened state) when the up-and-down airflow direction plate driving motor 51 as illustrated in FIG. 5 is driven. A distal end 27*ab* of the up-and-down airflow direction plate 27 is turned about the rotation shaft 32*a* along an arcuate locus.

Up-and-Down Airflow Direction Assist Plate 31

The front surface wall 22*b* is located on the front surface side of the air outlet 22 and at an upper level than the up-and-down airflow direction plate 27. The rotation shaft 33 configured to rotate the up-and-down airflow direction assist plate 31 is provided in the vicinity of a surface of the front surface wall 22*b* on the air passage side. The rotation shaft 33 is provided on the internal side of the casing and located inward of the opening portion of the air outlet 22. When the up-and-down airflow direction plate 27 covers the air outlet 22, the rotation shaft 33 is located above the up-and-down airflow direction plate 27. A plate-like portion 31*a* of the up-and-down airflow direction assist plate 31 is formed on a distal end of an arm portion 34 extending from the rotation shaft in the radial direction of rotation thereof. The up-and-down airflow direction assist plate 31 is installed so that a surface of the plate-like portion 31*a* is substantially parallel to a direction along the rotation direction about the rotation shaft 33. That is, the surface of the plate-like portion 31*a* of the up-and-down airflow direction assist plate 31 faces the rotation shaft 33.

The up-and-down airflow direction assist plate 31 is turnable about the rotation shaft 33 toward the front side or back side with respect to the casing 60. As illustrated in FIG. 3, in the operation stopped state, the up-and-down airflow direction assist plate 31 is accommodated in the inside of the air outlet 22, and the plate-like portion 31*a* is accommodated such that an end portion thereof faces downward to close part of the air passage 40. However, as illustrated in FIG. 4, in the operation state, the plate-like portion 31*a* can be positioned so as to be substantially horizontal by causing the entire plate-like portion 31*a* to protrude downward from the lower end of the air outlet 22. Further, the plate-like portion 31*a* of the up-and-down airflow direction assist plate 31 extends along the longitudinal direction of the air outlet 22, that is, the right-and-left direction of the indoor unit 2, and can change the up-and-down airflow direction of the main flow F1 of the blowing air to be blown out through the air outlet 22. The plate-like portion 31*a* of the up-and-down airflow direction assist plate 31 forms the air outlet passage together with the plate-like portion 27*a* of the up-and-down airflow direction plate 27. In Embodiment 1, the plate-like portion 31*a* of the up-and-down airflow direction assist plate 31 has a plate-like shape having a curved surface. However, the plate-like portion 31*a* of the up-and-down airflow direction assist plate 31 may have a flat plate-like shape as long as it can guide the blowing air.

The up-and-down airflow direction assist plate 31 is turnable about the rotation shaft 33 FIG. in the range from a rear-structure contact state which is an accommodated state as illustrated in FIG. 3 to a front-structure contact state, when the up-and-down airflow direction assist plate driving motor 53 as illustrated in FIG. 5 is driven. The front structure abutment state is a state in which the up-and-down airflow direction assist plate 31 is further turned toward the front side from the position of the up-and-down airflow direction assist plate 31 illustrated in FIG. 4 so that the arm portion 34 is brought into contact with the terminal end 22*bb* of the front surface wall 22*b*. A distal end of the up-and-down airflow direction assist plate 31 is turned about the rotation shaft 33 along an arcuate locus.

Positional Relationship Between Up-and-Down Airflow Direction Plate 27 and Up-and-Down Airflow Direction Assist Plate 31

As illustrated in FIGS. 3 and 4, the rotation shaft 33 of the up-and-down airflow direction assist plate 31 is located on the front side in the inside of the air outlet 22, and the rotation shaft 32*a* of the up-and-down airflow direction plate 27 is located on the back surface side in the inside of the air outlet 22. As illustrated in FIG. 3, in the operation stopped state, the up-and-down airflow direction plate 27 covers the air outlet 22 while the plate-like portion 27*a* is horizontal. Further, the entire up-and-down airflow direction assist plate 31 is accommodated in the inside of the air outlet 22 by moving the plate-like portion 31*a* toward the back surface side. In the operation stopped state, the up-and-down airflow direction assist plate 31 is provided above the up-and-down airflow direction plate 27, and the rotation shaft 33 is located above the distal end 27*ab* of the up-and-down airflow direction plate 27. Further, the plate-like portion 31*a* of the up-and-down airflow direction assist plate 31 is positioned on the front side with respect to the rotation shaft 32*a* of the up-and-down airflow direction plate 27 and above the plate-like portion 27*a* of the up-and-down airflow direction plate 27. In the operation stopped state, as described above, the up-and-down airflow direction plate 27 and the up-and-down airflow direction assist plate 31 are accommodated in the air outlet 22. Thus, dust in the room does not accumulate.

From the operation stopped state as described above, the distal end 27*ab* of the up-and-down airflow direction plate 27 is turned from the front surface side of the casing 60 toward the back surface side thereof, to thereby open the air outlet 22. The up-and-down airflow direction assist plate 31 is turned such that its distal end is oriented from the back surface side of the casing 60 toward the front surface side thereof, after the up-and-down airflow direction plate 27 is turned until it reaches a position where it does not cross the arcuate locus of the rotation of the up-and-down airflow direction assist plate 31. The locus of the rotation of the up-and-down airflow direction plate 27 and the locus of the rotation of the up-and-down airflow direction assist plate 31 cross each other. Thus, during the opening and closing operations of the air outlet 22 or an operation of changing the airflow direction, it is required that the up-and-down airflow direction plate 27 and the up-and-down airflow direction assist plate 31 be operated without contacting each other. However, with this configuration, the blowing air can be freely adjusted in the up-and-down direction while accommodating the two airflow direction plates in a small space, and further, a large air outlet passage can be secured during the operation of the indoor unit 2.

Flow of Air in Indoor Unit 2 According to Embodiment 1

Now, with reference to FIGS. 3 and 4, a flow of air in the indoor unit 2 is described. The arrows A illustrated in the vicinities of the air inlet 21*a* and the air inlet 21*b* as illustrated in FIG. 4 each indicate the flow of air taken into the indoor unit 2 through the air inlet. The air sucked through the air inlets 21 arranged in the top surface and the front surface of the indoor unit 2 is subjected to heat exchange with refrigerant flowing through the indoor heat exchanger 4 when the air passes through the indoor heat exchanger 4. The air passing through the indoor heat exchanger 4 is cooled during the cooling operation of the air-conditioning apparatus 1, or is heated during the heating operation of the air-conditioning apparatus 1. The conditioned air having passed through the indoor heat exchanger 4 and having been subjected to heat exchange with the refrigerant flows to the indoor fan 5. The air having passed through the indoor fan 5 or a gap between the indoor fan 5 and the back panel 65 passes through the air passage 40, and is adjusted in the right-and-left direction by the airflow direction plates 30. The air having passed through the airflow direction plates 30 is blown out frontward or downward from the indoor unit 2 through the air outlet 22 along the up-and-down airflow direction plate 27 and the up-and-down airflow direction assist plate 31 installed in the air outlet 22.

When the indoor unit 2 is in the operation state, the up-and-down airflow direction plate 27 is turned about the rotation shaft 32*a* provided in the vicinity of the lower end of the opening of the air outlet 22 to move the distal end 27*ab* toward the region located below the air outlet 22 so that the distal end 27*ab* is directed obliquely downward with respect to the indoor unit 2. The plate-like portion 27*a* of the up-and-down airflow direction plate 27 is located close to the rotation shaft 32*a*. Thus, even when the up-and-down airflow direction plate 27 is turned to open the air outlet 22, an upstream end portion 27*aa* of the plate-like portion 27*a* is located in the opening portion of the air outlet 22. Therefore, the plate-like portion 27*a* of the up-and-down airflow direction plate 27 protrudes obliquely downward with respect to the casing 60, with the opening portion of the air outlet 22 set as the starting point. When the up-and-down airflow direction assist plate 31 is accommodated in the air outlet 22 as illustrated in FIG. 3, and then when it is turned about the rotation shaft 33 provided in the vicinity of the lower end of the opening of the air outlet 22 it is projected downward from the air outlet 22, and is located such that the plate-like portion 31*a* for guiding the blowing air is substantially horizontal. The plate-like portion 31*a* of the up-and-down airflow direction assist plate 31 is provided far from the rotation shaft 33. Thus, when the up-and-down airflow direction assist plate 31 is turned by a predetermined angle, a protruding portion 31*aa* and a downstream end portion 31*ab* of the plate-like portion 31*a* are moved to protrude from the opening portion of the air outlet 22. With this configuration, the plate-like portion 31*a* of the up-and-down airflow direction assist plate 31 can be located on the front surface side of the casing 60 in the vicinity of the distal end 27*ab* of the up-and-down airflow direction plate 27. That is, the plate-like portion 27*a* of the up-and-down airflow direction plate 27 is located on the upstream side of the air outlet passage, and the plate-like portion 31*a* of the up-and-down airflow direction assist plate 31 is located on the downstream side of the air outlet passage. In this manner, the up-and-down airflow direction plate 27 and the up-and-down airflow direction assist plate 31 are arranged continuously from the opening portion of the air outlet 22, thereby forming the air outlet passage. The blowing air is guided by the up-and-down airflow direction plate 27 and the up-and-down airflow direction assist plate 31, and is blown out toward the front surface side of the casing 60. When the plate-like portion 31*a* is projected from the air outlet 22, the greater the distance between the plate-like portion 31*a* and the terminal end 22*bb* of the front surface wall 22*b* in the air passage in the inside of the air outlet 22, the greater the area of the air outlet passage, as a result of which an air passage resistance made when an airflow in a horizontal direction is generated can be reduced.

The up-and-down airflow direction plate 27 can be stopped not only at an angle as illustrated in FIG. 4 but at an angle which varies in the range from the angle at which it is inclined when it closes the air outlet 22 as illustrated in FIG. 3 to the angle at which it is inclined when the distal end 27*ab* faces the region located just below the casing 60. The up-and-down airflow direction assist plate 31 can also be turned at an angle which varies in the range from the angle at which it is located when accommodated in the inside of the air outlet 22 as illustrated in FIG. 3 to the angle at which it is located when being substantially horizontal as illustrated in FIG. 4. The up-and-down airflow direction plate 27 and the up-and-down airflow direction assist plate 31 are provided so as to be turnable as described above. Thus, during the operation, the angle at which the air is blown out can be changed such that the air is brown out not only downward but frontward. In the positions of the up-and-down airflow direction plate 27 and the up-and-down airflow direction assist plate 31 as illustrated in FIG. 4, the indoor unit 2 is in a state in which it blows out air frontward. The main flow F1 of the blowing air is guided by the upstream guide surface 26*a* and the downstream guide surface 26*b* of the up-and-down airflow direction plate 27 and the plate-like portion 31*a* of the up-and-down airflow direction assist plate 31, to thereby be blown out forward from the indoor unit 2.

Figure 6:
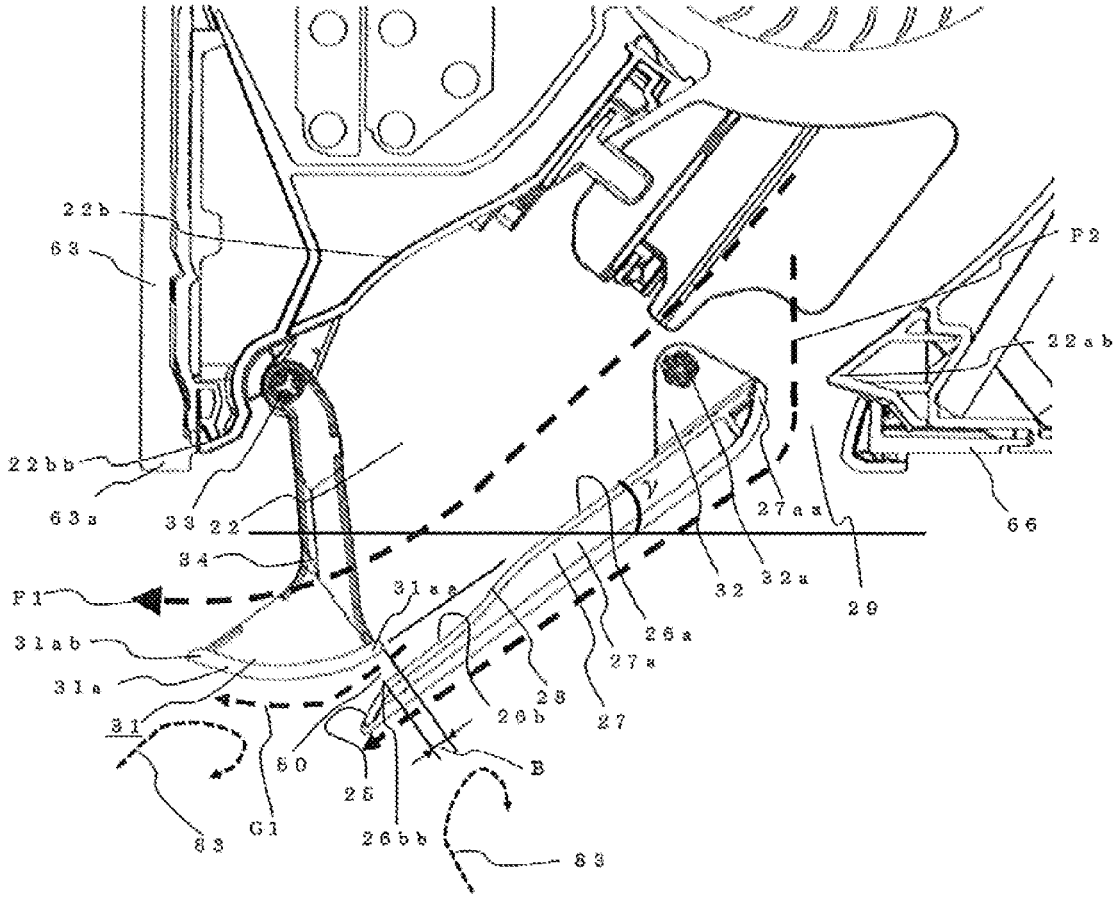
FIG. 6 is an enlarged view of a periphery of an air outlet as illustrated in FIG. 4.

FIG. 6 is an enlarged view of a periphery of the air outlet 22 of FIG. 4. The plate-like portion 27*a* of the up-and-down airflow direction plate 27 is opened at an angle γ with respect to the horizontal direction. After the blowing air passes through the airflow direction plates 30, the blowing air is divided into two flows: the main flow F1, which is guided by the surface on the upper side of the up-and-down airflow direction plate 27, that is, the surface facing the inside of the casing during operation stop, and is changed in the airflow direction; and the sub-flow F2, which is to flow out through the gap 29 between the terminal end 22*ab* of the back surface wall 22*a* and a periphery portion of the rotation shaft 32*a* of the up-and-down airflow direction plate 27. After the sub-flow F2 flows out from the indoor unit 2 through the gap 29, due to the Coanda effect, the sub-flow F2 flows along the surface on the outer side of the up-and-down airflow direction plate 27, that is, a surface on a side serving as a design surface when the air outlet 22 is closed during operation stop. On the other hand, the main flow F1 is blown onto the upstream guide surface 26*a* of the up-and-down airflow direction plate 27 so that the airflow direction of the main flow F1 is changed to the direction along the front surfaces of the upstream guide surface 26*a* and the downstream guide surface 26*b*. The main flow F1 changed in the flow direction passes over the plate-like portion 31*a* of the up-and-down airflow direction assist plate 31, which is directed substantially horizontally, and is blown out forward from the indoor unit 2. The downstream guide surface 26*b* of the up-and-down airflow direction plate 27 and the plate-like portion 31*a* of the up-and-down airflow direction assist plate 31 are arranged with a gap 50 therebetween so that the blowing air flows in a direction in which the distal end 27*ab* of the up-and-down airflow direction plate 27 faces. After part of the main flow F1 flowing along the front surface of the up-and-down airflow direction plate 27 flows along the downstream guide surface 26*b*, the part of the main flow F1 flows through the gap 50 as a sub-flow G1. Due to the Coanda effect, the sub-flow G1 flowing through the gap 50 flows along a surface on a lower side of the plate-like portion 31*a* of the up-and-down airflow direction assist plate 31, that is, a surface on a side not facing the rotation shaft 33.

At this time, the protruding portion 31*aa* of the plate-like portion 31*a* of the up-and-down airflow direction assist plate 31 is located on the upstream side with respect to a downstream guide surface distal end portion 26*bb* corresponding to an end portion of the downstream guide surface 26*b* on the downstream side. That is, the plate-like portion 31*a* of the up-and-down airflow direction assist plate 31 and the downstream guide surface 26*b* overlap with each other by a dimension B illustrated in FIG. 6 in the flow direction of the blowing air. Further, a tangent line to the surface on the lower side of the plate-like portion 31*a* of the up-and-down airflow direction assist plate 31 at the protruding portion 31*aa* is substantially parallel to the downstream guide surface 26*b*. With this configuration, the sub-flow G1 flowing through the gap 50 more easily flows along the lower surface of the plate-like portion 31*a* of the up-and-down airflow direction assist plate 31. Further, the protruding portion 31*aa* of the plate-like portion 31*a* of the up-and-down airflow direction assist plate 31 is located on an imaginary plane that extends from the upstream guide surface 26*a* to a downstream side of the air outlet passage. With this configuration, the main flow F1 of the blowing air flows through the air outlet passage formed by the up-and-down airflow direction plate 27 and the up-and-down airflow direction assist plate 31, thereby preventing the sub-flow G1 from flowing through the gap 50 at a higher rate than necessary.

As described above, the sub-flow F2 and the sub-flow G1 respectively flow along the surfaces of the up-and-down airflow direction plate 27 and the up-and-down airflow direction assist plate 31, which are located opposite to the surfaces thereof which face the main flow F1, thereby being capable of preventing occurrence of a temperature difference in air between both the surfaces of each of the plate-like portion 27*a* of the up-and-down airflow direction plate 27 and the plate-like portion 31*a* of the up-and-down airflow direction assist plate 31. That is, when the indoor unit 2 for the air-conditioning apparatus performs the cooling operation, warm and wet indoor air 83 can be prevented from contacting the plate-like portion 27*a* of the up-and-down airflow direction plate 27 and the plate-like portion 31*a* of the up-and-down airflow direction assist plate 31, thereby being capable of preventing occurrence of dew condensation on the up-and-down airflow direction plate 27 and the up-and-down airflow direction assist plate 31.

Structure for Preventing Failure

Figure 7:
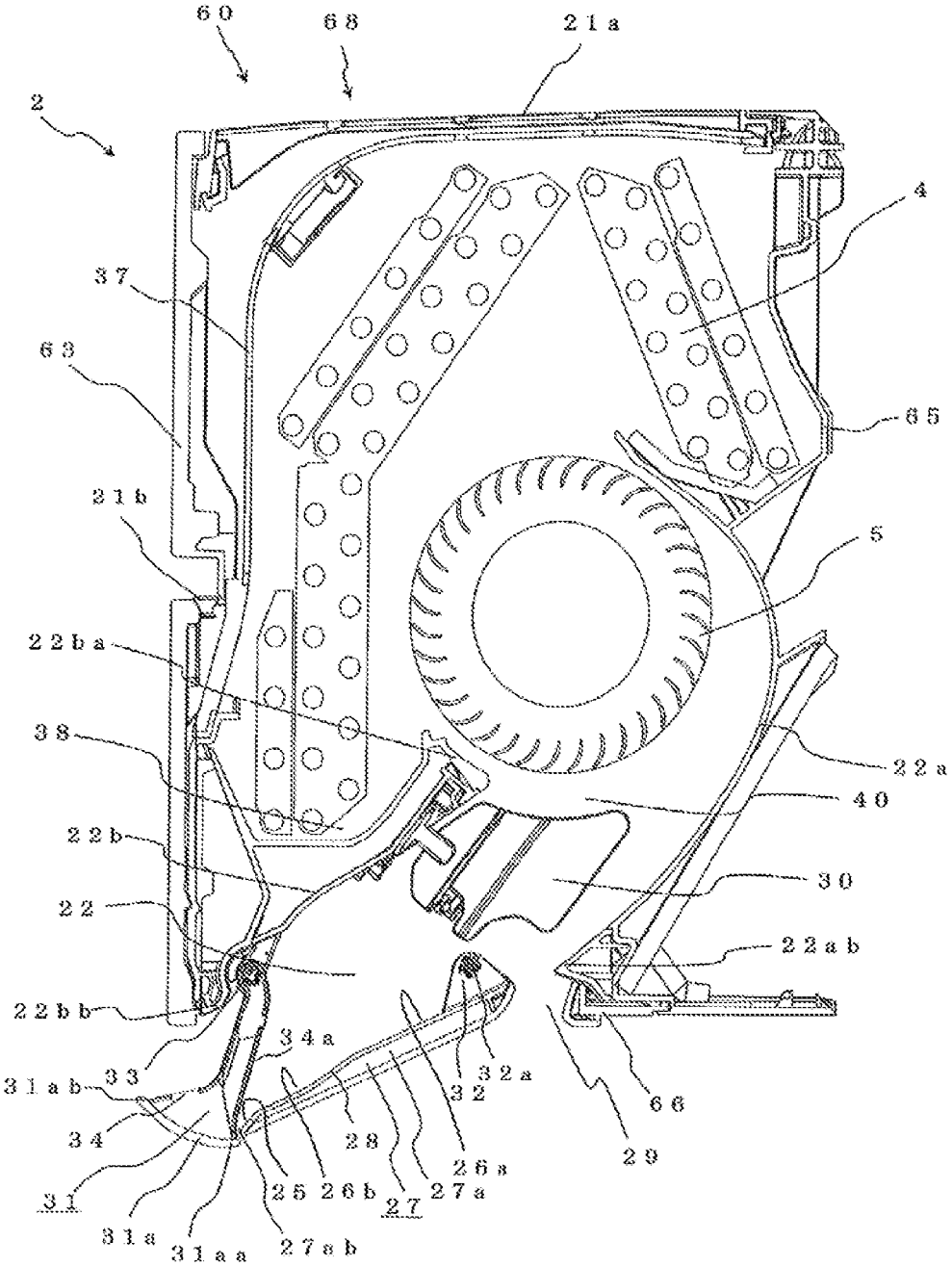
FIG. 7 is an explanatory view for illustrating a cross section of the indoor unit in a state in which an up-and-down airflow direction plate and an up-and-down airflow direction assist plate are held in contact with each other.
Figure 8:
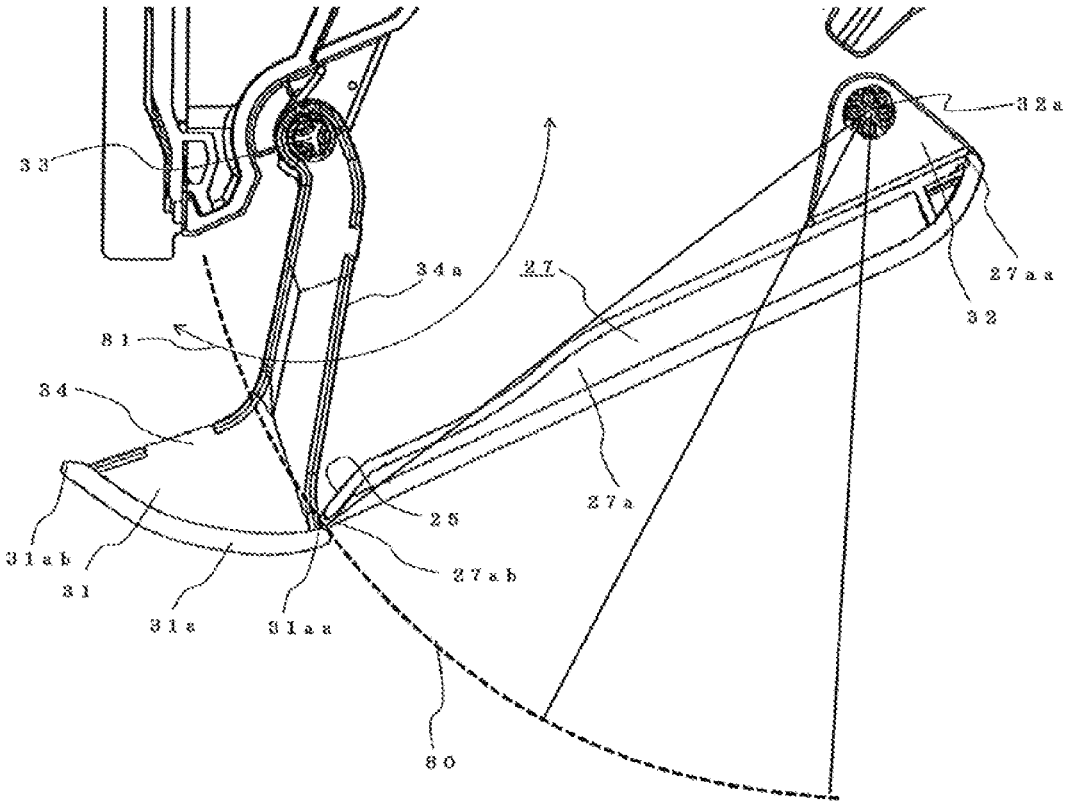
FIG. 8 is an enlarged view of a periphery of the air outlet as illustrated in FIG. 7.

FIG. 7 is an explanatory view for illustrating a cross section of the indoor unit 2 in a state in which the up-and-down airflow direction plate 27 and the up-and-down airflow direction assist plate 31 are in contact with each other. FIG. 8 is an enlarged view of a periphery of the air outlet 22 of FIG. 7. The up-and-down airflow direction plate 27 and the up-and-down airflow direction assist plate 31 are driven independently of each other, and hence can be fixed at respective arbitrary angles. According to normal rotation drive control of the up-and-down airflow direction plate 27 and the up-and-down airflow direction assist plate 31, the up-and-down airflow direction plate 27 and the up-and-down airflow direction assist plate 31 are driven without being brought in contact with each other. However, when an external force is applied to the up-and-down airflow direction plate 27 and/or the up-and-down airflow direction assist plate 31, for example, they or it is manually moved, there is a case where the distal end 27*ab* of the up-and-down airflow direction plate 27 and a portion of the back surface side of the up-and-down airflow direction assist plate 31 are brought in contact with each other. When the distal end 27*ab* of the up-and-down airflow direction plate 27 is brought in contact with the portion of the back surface side of the up-and-down airflow direction assist plate 31, the distal end 27*ab* of the up-and-down airflow direction plate 27 is caught on the portion of the back surface side of the up-and-down airflow direction assist plate 31, their movement is restricted. As a result, the up-and-down airflow direction plate 27 and the up-and-down airflow direction assist plate 31 become non-rotatable. This may cause a failure. Therefore, the structure according to Embodiment 1 is provided to prevent the up-and-down airflow direction plate 27 and the up-and-down airflow direction assist plate 31 from being non-rotatable even when the distal end 27*ab* of the up-and-down airflow direction plate 27 is brought in contact with the portion of the back surface side of the up-and-down airflow direction assist plate 31.

With reference to FIG. 8, the structure for preventing the up-and-down airflow direction plate 27 and the up-and-down airflow direction assist plate 31 from becoming non-rotatable is described in detail. A locus 80 illustrated by the dotted line in FIG. 8 indicates a locus of rotation of a distal end 27*ab* of the up-and-down airflow direction plate 27 about the rotation shaft 32*a* of the up-and-down airflow direction plate 27. In FIGS. 7 and 8, the distal end 27*ab* of the up-and-down airflow direction plate 27 is in contact with a boundary portion between the protruding portion 31*aa* of the plate-like portion 31*a* of the up-and-down airflow direction assist plate 31 and a back surface portion 34*a* of the arm portion 34. At this time, in the case where the portion of the back surface side of the up-and-down airflow direction assist plate 31 does not have a protrusion on which the distal end 27*ab* of the up-and-down airflow direction plate 27 may be caught, the rotating operation of the up-and-down airflow direction plate 27 is not inhibited. That is, when the up-and-down airflow direction assist plate 31 is projected from the air outlet 22, in the case where the surface of the up-and-down airflow direction assist plate 31, which faces the up-and-down airflow direction plate 27 side, does not have the protrusion on which the distal end 27*ab* of the up-and-down airflow direction plate 27 may be caught or a recessed portion in which the distal end 27*ab* of the up-and-down airflow direction plate 27 may be fitted, the rotating operation of the up-and-down airflow direction plate 27 is not inhibited.

Figure 9:
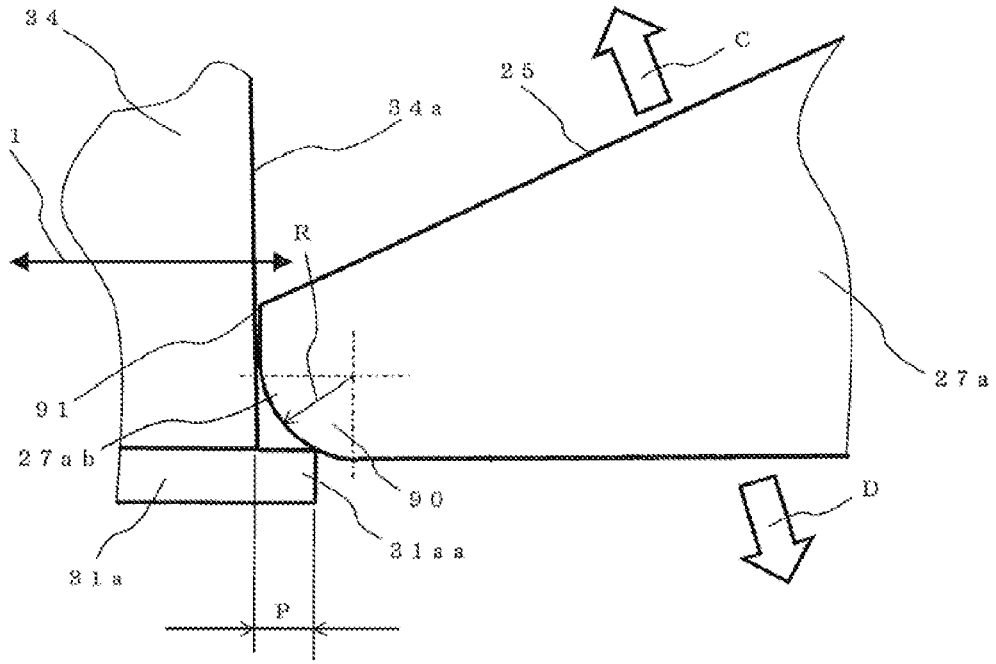
FIG. 9 is an enlarged schematic view of a contact portion between the up-and-down airflow direction plate and the up-and-down airflow direction assist plate as illustrated in FIG. 8.

FIG. 9 is a further enlarged schematic view of the contact portion between the up-and-down airflow direction plate 27 and the up-and-down airflow direction assist plate 31 of FIG. 8. In FIG. 8, the distal end 27*ab* of the up-and-down airflow direction plate 27 is in contact with the boundary portion between the protruding portion 31*aa* of the plate-like portion 31*a* of the up-and-down airflow direction assist plate 31 and the back surface portion 34*a* of the arm portion 34. In contrast, FIG. 9 is a view for illustrating the case in which the protruding portion 31*aa* is projected from the back surface portion 34*a* of the arm portion 34 by a protruding dimension P. A ridge line portion 90 on a lower side of the distal end 27*ab* of the up-and-down airflow direction plate 27 is rounded into a curved surface having a radial dimension R. On the other hand, the protruding portion 31*aa* of the up-and-down airflow direction assist plate 31 is projected from the back surface portion 34*a* of the arm portion 34 by the protruding dimension P. In FIG. 9, a relationship between the radial dimension R and the protruding dimension P is R>P. The direction D illustrated in FIG. 9 indicates a rotational movement direction of the up-and-down airflow direction plate 27. Further, a locus 81 indicates a rotation locus of the up-and-down airflow direction assist plate 31 at a predetermined position. When the up-and-down airflow direction plate 27 is moved in the direction D, as the radial dimension R is set larger than the protruding dimension P, and further the up-and-down airflow direction assist plate 31 has play in the rotation direction. Thus, the distal end 27*ab* of the up-and-down airflow direction plate 27 can be moved in the direction D without being caught on the protrusion. That is, even in the case where the back surface portion of the up-and-down airflow direction assist plate 31 has the protrusion that may inhibit movement of the up-and-down airflow direction plate 27 in the moving direction, when the protruding dimension P is smaller than the radial dimension R of the roundness formed on the ridge line portion 90 on the distal end 27*ab* of the up-and-down airflow direction plate 27, the up-and-down airflow direction plate 27 can be rotationally moved.

In Embodiment 1, when the indoor unit 2 is turned on or turned off, the up-and-down airflow direction plate 27 is controlled to perform an opening operation. That is, the up-and-down airflow direction plate 27 is controlled to rotate in the direction D illustrated in FIG. 9. This control is performed so as to prevent the up-and-down airflow direction plate 27 from entering the rotation locus of the up-and-down airflow direction assist plate 31 and inhibiting the rotational movement of the up-and-down airflow direction assist plate 31. In the state illustrated in FIGS. 7 and 9 in which the up-and-down airflow direction plate 27 and the up-and-down airflow direction assist plate 31 are in contact with each other, control is performed so as to release the up-and-down airflow direction plate 27 and the up-and-down airflow direction assist plate 31 from their contact state.

In FIG. 9, only the ridge line portion 90 formed between the surface on the lower side of the up-and-down airflow direction plate 27 and the end surface of the distal end 27*ab* of the up-and-down airflow direction plate 27 is rounded so as to have the radial dimension R. However, a ridge line portion 91 formed between the end surface of the distal end and the tapered surface 25 may also be rounded so as to have the radial dimension R. In the case where the ridge line portion 91 is also rounded, even when the protruding portion 31*aa* is formed on an upper side with respect to the distal end 27*ab* in FIG. 9, the up-and-down airflow direction plate 27 can be moved in the direction C.

Advantages of Present Invention

In Embodiment 1, the indoor unit 2 for the air-conditioning apparatus 1 includes: the casing 60, which is to be attached to the wall surface K in a room at the back surface side; the air inlets 21 and the air outlet 22, which are formed in the casing 60; the indoor heat exchanger 4 and the indoor fan 5, which are arranged in the air passage continuous from the air inlets 21 to the air outlet 22; the up-and-down airflow direction plate 27, which is provided in the air outlet 22 so as to be turnable, forms the air outlet passage for the blowing air to be blown out through the air outlet in the region located below the air outlet 22, and is configured to change the direction of the blowing air to the up or down direction; and the up-and-down airflow direction assist plate 31, which is turned and located on the front surface side of the casing 60 with respect to the up-and-down airflow direction plate 27, forms the air outlet passage at the position located below the lower end of the air outlet 22, and is configured to change the direction of the blowing air to the up or down direction. The rotation locus 80 of the distal end 27*ab* of the up-and-down airflow direction plate 27 crosses the locus 81 of the up-and-down airflow direction assist plate 31. The distal end 27*ab* of the up-and-down airflow direction plate 27 includes the ridge line portion 90 having the curved surface having the radial dimension R. The up-and-down airflow direction assist plate 31 includes the protruding portion 31*aa* protruding by the protruding dimension P on the surface with which the distal end 27*ab* of the up-and-down airflow direction plate 27 may be brought in contact. The protruding dimension P of the protruding portion 31*aa* is smaller than the radial dimension R. In Embodiment 1, the surface with which the distal end 27*ab* of the up-and-down airflow direction plate 27 may be brought in contact corresponds to the back surface portion 34*a* of the arm portion 34 and the upstream end portion 31*aa* of the plate-like portion 31*a*.

With this configuration, in the indoor unit 2 for the air-conditioning apparatus 1, even when the up-and-down airflow direction plate 27 and the up-and-down airflow direction assist plate 31 are brought in contact with each other due to an external force, the distal end 27*ab* of the up-and-down airflow direction plate 27 is prevented from being caught on the up-and-down airflow direction assist plate 31, thereby from being restricted.

In the indoor unit 2 for the air-conditioning apparatus 1 according to Embodiment 1, the up-and-down airflow direction assist plate 31 is turned about the up-and-down airflow direction assist plate rotation shaft 33, and includes: the arm portion 34 extending from the up-and-down airflow direction assist plate rotation shaft 33; and the plate-like portion 31*a*, which is provided on an end portion of the arm portion 34 which is located opposite to another end portion thereof on which the rotation shaft 33 of the up-and-down airflow direction assist plate 31 is provided. The protruding portion 31*aa* is formed by projecting the plate-like portion 31*a* from the back surface side end surface of the arm portion 34.

With this configuration, the plate-like portion 31*a* can be projected from the back surface side end surface of the arm portion 34 of the up-and-down airflow direction assist plate 31, and the shape of the up-and-down airflow direction assist plate 31 is therefore flexible.

The indoor unit 2 for the air-conditioning apparatus 1 according to Embodiment 1 includes the up-and-down airflow direction plate rotation shaft 32*a*, which, corresponds to the center of turning of the up-and-down airflow direction plate 27, and the up-and-down airflow direction assist plate rotation shaft 33, which corresponds to the center of turning of the up-and-down airflow direction assist plate 31. The up-and-down airflow direction plate rotation shaft 32*a* is located on the back surface side in the inside of the air outlet 22. The up-and-down airflow direction assist plate rotation shaft 33 is located on the front surface side in the inside of the air outlet 22 with respect to the up-and-down airflow direction plate rotation shaft 32*a*. The up-and-down airflow direction plate 27 is turned in a direction from the front surface of the casing 60 toward the back surface thereof at the time of start of the operation. The up-and-down airflow direction assist plate 31 is turned in an opposite direction to the turning direction of the up-and-down airflow direction plate 27 at the time of start of the operation.

With this configuration, the up-and-down airflow direction plate 27 and the up-and-down airflow direction assist plate 31 can be arranged in a small space, and a large air outlet passage can be secured during the operation. In such a configuration, the up-and-down airflow direction plate 27 and the up-and-down airflow direction assist plate 31 have a positional relationship in which they will easily be brought in contact with each other. However, as described above, even when the up-and-down airflow direction plate 27 and the up-and-down airflow direction assist plate 31 are brought in contact with each other, the distal end 27*ab* of the up-and-down airflow direction plate 27 is prevented from being caught on the up-and-down airflow direction assist plate 31, and being held.

In the indoor unit 2 for the air-conditioning apparatus 1 according to Embodiment 1, the ridge line portion 90 is made up of the lower surface of the up-and-down airflow direction plate 27 and the end surface of the distal end 27*ab*.

With this configuration, in particular, in the positional relationship between the up-and-down airflow direction plate 27 and the up-and-down airflow direction assist plate 31 as in Embodiment 1, although the plate-like portion 31*a* of the up-and-down airflow direction assist plate 31 is projected from the back surface side of the arm portion 34, the up-and-down airflow direction plate 27 can be moved in the downward direction. It suffices that the R shape of the ridge line portion 90 formed on the up-and-down airflow direction plate 27 is formed in a minimum necessary range, and thus the up-and-down airflow direction plate 27 also has a higher degree of flexibility in manufacture.

In the indoor unit 2 for the air-conditioning apparatus 1 according to Embodiment 1, the up-and-down airflow direction assist plate 31 is accommodated in the inside of the air outlet 22 during operation stop. Further, the up-and-down airflow direction plate 27 covers the air outlet 22 during operation stop.

With this configuration, the up-and-down airflow direction plate 27 and the up-and-down airflow direction assist plate 31 can be arranged in a small space. Also, during operation stop, the up-and-down airflow direction assist plate 31 is accommodated in the inside, thereby improving the outer appearance of the indoor unit 2. Further, during operation stop, the lower surface of the up-and-down airflow direction plate 27 is seen as the outer appearance, and the upper surface of the up-and-down airflow direction plate 27 and the up-and-down airflow direction assist plate 31 are located in regions that cannot be seen from the outside. Thus, it suffices that the outer appearance of the surface on the lower side of the up-and-down airflow direction plate 27 is made equivalent in quality to that of the outer appearance of the casing 60. It is therefore possible to decrease the cost of the components to the minimum.

The invention claimed is:

1. An indoor unit for an air-conditioning apparatus, comprising:

a casing, which is to be attached to a wall in a room on a back surface side of the casing;

an air inlet and an air outlet, which are formed in the casing;

an indoor heat exchanger and an indoor fan, which are arranged in an air passage continuous from the air inlet to the air outlet;

an up-and-down airflow direction plate, which is provided in the air outlet so as to be turnable, and forms an air outlet passage for blowing air to be blown out through the air outlet in a region located below the air outlet, and which is configured to change a direction of the blowing air between upward and downward directions; and an up-and-down airflow direction assist plate, which is turned closer to a front surface side of the casing than the up-and-down airflow direction plate, thereby forming the air outlet passage at a position located below the air outlet, and is configured to change the direction of the blowing air in the up-and-down direction, wherein a rotation locus of a distal end of the up-and-down airflow direction plate crosses a locus of the up-and-down airflow direction assist plate, wherein the distal end of the up-and-down airflow direction plate includes a ridge line portion having a curved surface having a radial dimension R, wherein the up-and-down airflow direction assist plate includes a protruding portion protruding by a protruding dimension P on a surface with which the distal end of the up-and-down airflow direction plate is allowed to be in contact, and wherein the protruding dimension P of the protruding portion is smaller than the radial dimension R.

2. An indoor unit for an air-conditioning apparatus, comprising:

a casing, which is to be attached to a wall in a room on a back surface side of the casing;

an air inlet and an air outlet, which are formed in the casing;

an indoor heat exchanger and an indoor fan, which are arranged in an air passage continuous from the air inlet to the air outlet;

an up-and-down airflow direction plate, which is provided in the air outlet so as to be turnable, and forms an air outlet passage for blowing air to be blown out through the air outlet in a region located below the air outlet, and which is configured to change a direction of the blowing air between upward and downward directions; and an up-and-down airflow direction assist plate, which is turned closer to a front surface side of the casing than the up-and-down airflow direction plate, thereby forming the air outlet passage at a position located below the air outlet, and is configured to change the direction of the blowing air in the up-and-down direction, wherein a rotation locus of a distal end of the up-and-down airflow direction plate crosses a locus of the up-and-down airflow direction assist plate, wherein the distal end of the up-and-down airflow direction plate includes a ridge line portion having a curved surface having a radial dimension R, wherein the up-and-down airflow direction assist plate includes a protruding portion protruding by a protruding dimension P on a surface with which the distal end of the up-and-down airflow direction plate is allowed to be in contact, wherein the protruding dimension P of the protruding portion is smaller than the radial dimension R, wherein the up-and-down airflow direction assist plate is turned about an up-and-down airflow direction assist plate rotation shaft, wherein the up-and-down airflow direction assist plate includes:

an arm portion extending from the up-and-down airflow direction assist plate rotation shaft; and a plate-like portion, which is provided on the arm portion on an end portion located opposite to an end portion on which the up-and-down airflow direction assist plate rotation shaft is provided, and wherein the protruding portion is formed by projecting the plate-like portion by the protruding dimension P from a back surface side end surface of the arm portion.

3. The indoor unit for an air-conditioning apparatus of claim 1, further comprising:

an up-and-down airflow direction plate rotation shaft that corresponds to a center of turning of the up-and-down airflow direction plate; and the up-and-down airflow direction assist plate rotation shaft that corresponds to a center of turning of the up-and-down airflow direction assist plate, wherein the up-and-down airflow direction plate rotation shaft is located on the back surface side in an inside of the air outlet, wherein the up-and-down airflow direction assist plate rotation shaft is located on the front surface side in the inside of the air outlet with respect to the up-and-down airflow direction plate rotation shaft, wherein the up-and-down airflow direction plate is turned in a direction from the front surface of the casing toward the back surface of the casing at the time of start of an operation, and wherein the up-and-down airflow direction assist plate is turned in an opposite direction to a turning direction of the up-and-down airflow direction plate at the time of the start of the operation.

4. The indoor unit for an air-conditioning apparatus of claim 1, wherein the ridge line portion is made up of a lower surface of the up-and-down airflow direction plate and an end surface of the distal end.

5. The indoor unit for an air-conditioning apparatus of claim 1, wherein the up-and-down airflow direction assist plate is accommodated in the inside of the air outlet during operation stop.

6. The indoor unit for an air-conditioning apparatus of claim 1, wherein the up-and-down airflow direction plate covers the air outlet during operation stop.

* * * * *